US006628208B1

(12) United States Patent
Morozumi et al.

(10) Patent No.: US 6,628,208 B1
(45) Date of Patent: Sep. 30, 2003

(54) MEASUREMENT DEVICE

(75) Inventors: Akio Morozumi, Matsumoto (JP); Takashi Sunaba, Matsumoto (JP)

(73) Assignee: T & D Corporation, Nagano (JP)

( * ) Notice: Subject to any disclaimer, the term of this patent is extended or adjusted under 35 U.S.C. 154(b) by 533 days.

(21) Appl. No.: 09/619,504

(22) Filed: Jul. 19, 2000

(51) Int. Cl.[7] ..... G08C 17/00

(52) U.S. Cl. ..... 340/870.28; 340/539; 340/870.11; 710/14

(58) Field of Search ..... 340/870.28, 539, 340/870.11; 455/9, 13.1, 456.1; 710/303, 106, 6, 19

(56) References Cited

U.S. PATENT DOCUMENTS

RE35,590 E * 8/1997 Bezos et al. ..... 455/456
5,666,495 A * 9/1997 Yeh ..... 710/303
6,292,108 B1 * 9/2001 Straser et al. ..... 340/870.11
6,453,687 B2 * 9/2002 Sharood et al. ..... 62/127

* cited by examiner

*Primary Examiner*—Michael Horabik
*Assistant Examiner*—Albert K. Wang
(74) *Attorney, Agent, or Firm*—Burns, Doane, Swecker & Mathis, L.L.P.

(57) ABSTRACT

A measurement device of the present invention includes a measurement portion for acquiring measured data from a sensor; a memory portion for storing the measured data; a radio portion for performing radio transmission/reception of the measured data; a PC interface portion for transmitting the measured data to a host computer via the universal interface; and a control portion for controlling the measurement portion, memory portion, radio portion, and PC interface portion, the control portion has a switching function for setting a mode by selecting between a remote mode and base mode; in the remote mode, the measured data acquired by the measurement portion are stored in the memory portion and transmitted by the radio portion, and in the base mode, the measured data acquired from the radio portion are stored in the memory portion and transmitted to the host computer by the PC interface portion. This measurement device allows construction of the measurement system capable of performing wireless measured data collection with the measurement devices of a single set of specifications. Therefore, the measurement system can be constructed in easy and flexible manner.

6 Claims, 6 Drawing Sheets

MEASUREMENT DEVICE

BACKGROUND OF THE INVENTION

1. Technical Field

The present invention relates to a measurement device capable of measuring physical quantity such as temperature and humidity.

2. Description of the Related Art

There is a system that monitors temperatures with the use of thermometers installed at appropriate intervals for the purpose of temperature control of an air conditioning system, quality maintenance of products, and the like in an office, a building, a factory, or a shop. In the past, temperatures were monitored by service persons for observing the respective thermometers installed at appropriate frequency and recording measured temperatures. Recently, in many cases, temperature-measuring units are connected to a central monitoring device via transmission cables for automatic temperature monitoring.

In a system where a large number of temperature measuring units are connected via transmission cables, connecting each of the temperature measuring units directly to a monitoring device may cause problems of insufficient monitoring device interfaces or excessive number of cables. Thus, it is necessary to reduce the number of the cables by providing a device capable of integrating a suitable number of temperature measuring units into one group and performing intermediate processing, or to connect a device capable of handling a lot of terminals such as a marshaling box to the monitoring device. As a result, even when the system is required to monitor the temperature only, it becomes complicated and high-priced to cover a wider measurement area having a large number of measuring points.

Moreover, in order to construct a system for monitoring the temperatures, it is necessary to prepare not only units for measuring the temperatures at remote ends but also plural kinds of devices, such as an intermediate processing device, or a terminal handling device and, needless to say, cables for connecting those units. Therefore, it is necessary to prepare an appropriate number of devices per each kind or purpose in addition to the measuring units depending on what kind of the building for temperature measurement or how large it is. The desired temperature measurement system can be realized only when the system design and appropriate kinds and quantities of materials are prepared in a reliable manner. Consequently, the system design is the essential factor, and the manufacturer for supplying temperature measurement systems should prepare sufficient kinds and quantities of devices other than the measuring units.

This requirement applies not only to the case for newly constructing the measurement system but also to the case for enlarging the area covered by the measurement system, changing measuring points or changing measuring system. When changing the measurement system, devices that have been used in the previous system are diverted to the new system. This results in limitation of the system configuration, failing to construct the optimum system.

This constraint or limitation applies not only to the temperature measurement system but also to other systems for measuring various types of physical quantity such as humidity, noise and amount of rainfall, by means of sensors.

Therefore, it is an object of the present invention to provide a measurement device that allows free configuration of the measurement system for collecting measured data from a large number of sampling points and facilitates change in the system using the minimum kinds of devices and/or units. Moreover, it is another object of the invention to provide a measurement device such that the manufacturer for supplying measurement systems can satisfy demands of the users in a flexible manner simply by preparing minimum kinds or types of devices and/or units.

SUMMARY OF THE INVENTION

The present invention provides a measuring device that is designed and manufactured in accordance with a single set of specifications and the measuring device employs radio communication as principle transmission/reception means of the data so as to construct the measurement system capable of collecting data through measurement devices and collecting the data acquired at respective locations. That is, the measurement device of the present invention includes a measurement portion for acquiring data from a sensor, a memory portion for storing the data, a radio portion for performing radio transmission/reception of the data, a PC interface portion for transmitting the data to a host computer via the universal interface, and a control portion for controlling the measurement portion, memory portion, radio portion, and PC interface portion. The control portion of the present measuring device has a switching function for setting a mode by selecting between a remote mode and base mode. In the remote mode, the data acquired by the measurement portion are stored in the memory portion and transmitted by the radio portion. In the base mode, the data acquired from the radio portion are stored in the memory portion and transmitted to the host computer by the PC interface portion.

Since the measurement device according to the present invention is designed to be able to send the data through radio transmission, no transmission cables or wires are required and a system for collecting data from a plurality of measuring points can easily be constructed. Further, by setting the measurement device in the remote mode, the measurement device acts as a remote unit for performing the measurement at each point. By setting the measurement device in the base (parent) mode, the measurement device acts as a base unit provided with a function of collecting data and transmitting them to the host computer for data collection via the universal interface with cable or an infrared ray interface etc. The computer serves as a monitoring device. In addition, the computer serves as an extra relay unit for covering an even wider area via a LAN.

Therefore, by adopting measurement devices of this invention designed and manufactured with a single set of specifications, installing them to the respective points, and setting each in a different mode depending on the installation point, the measurement system that obtains and collects data from a large number of points is constructed. Consequently, by using the measurement devices according to the present invention, the measurement system can be constructed in a flexible manner, eliminating problems of excess or lack in the instrument for the particular purpose as well as other materials. The system can also be readily changed. The measurement devices of a single set of specifications may allow construction of the system in conformity with the object subjected to measurement can be constructed in a configuration suited thereto.

Moreover, the manufacturer is required to simply produce measurement devices of the same kind that is designed and fabricated in accordance with a single set of specifications for the remote unit and base unit and supply them, which eliminates costs for production management or inventory management. As a result, the measurement devices can be supplied at lower costs. In addition, the manufacturer may reliably cope with user's demand of constructing the system of various designs by simply supplying the same type or kind of the present measurement devices of a single set of specifications without partitioning remote unit and base unit.

Furthermore, the measurement device according to the present invention temporarily stores the measured data in the memory portion for data transmission/reception. Therefore the time required for the communication can be minimized and a low power consumption system can be constructed. Considering especially the case where the measurement device is set in the remote mode, it is often the case that external power sources such as a power from wall socket cannot be used. Instead the built-in battery has to be used for the measurement and transmission/reception of data. It is, thus, important to minimize the time for the data transmission/reception. In addition, intermittent operation of the radio portion may reduce power consumption of the measurement device in the remote mode.

In order to send the data to a measurement device in the base mode from the measurement devices of remote mode, a communication method having following steps is preferable: the measurement device of the base mode transmits a broadcast call that calls the measurement devices of remote mode for a period equal to or longer than an intermittent cycle, the call is received by the measurement devices of remote mode so as to synchronize timing counters of the measurement devices of remote mode; and after an end of the broadcast calling, the measurement devices of remote mode are brought into the ready to transmission/receive state in a predetermined order for transmitting the measured data to the measurement device of base mode.

Moreover, preferably the measurement device is selectively provided with a relay mode, in addition to the remote mode and the base mode, where the measured data acquired by the radio portion is stored in the memory portion and transmitted by radio portion. With this mode, even when the measurement device in the remote mode is installed in such a point that a radio wave cannot reach or hardly reach, reliable data exchange between the measurement device in the remote mode (hereinafter referred to "remote-mode device") and the measurement device in the base mode (hereinafter referred to "base-mode device") can be established by installing the measurement device selected in the relay mode (hereinafter referred to "relay-mode device") intermediately.

The switching of the mode among base, remote and relay modes can be performed using a dipswitch or the like. However, if the switching is operable by software via the PC interface portion, it is convenient for the user because status of the switching can be confirmed on the computer. In addition, it is preferable that the control portion has identification information for transmission/reception being set by the host computer via the PC interface portion. By the identification information, the measurement devices can be given any setting freely which are to be required in constructing a highly-sophisticated, flexible measurement system, such as grouping of the remote-mode devices, assigning of a relay-mode device to each of the groups. Therefore, the present invention can provide measurement devices according to the single set of specifications that can construct the measurement system in a flexible manner at the high level.

DESCRIPTION OF THE PREFERRED EMBODIMENT

Figure 1A:
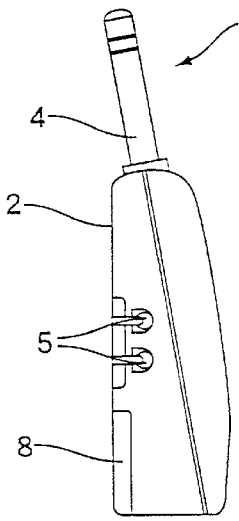
FIG. 1*a* shows a left side view, FIG. 1*b* a front view, FIG. 1*c* a right side view, and FIG. 1*d* a temperature sensor.
Figure 1B:
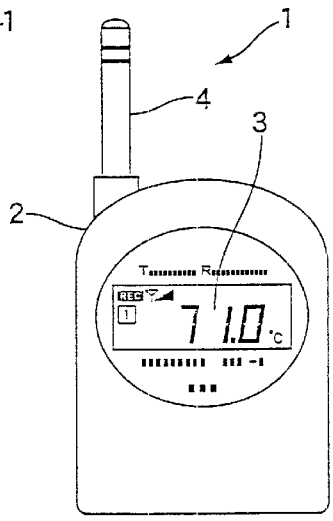
FIG. 1 is a schematic diagram of a temperature measurement device according to the present invention, where
Figure 1C:
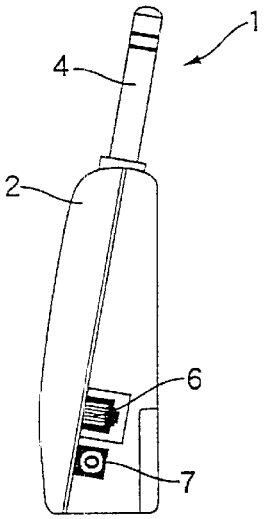

Referring to the drawings, the present invention will be further described. FIG. 1 is a schematic view of a measurement device 1 according to the present invention. The measurement device 1 of this embodiment is capable of measuring the temperature at an interval. As shown in the front view (FIG. 1*b*), the left side view (FIG. 1*a*), and the right side view (FIG. 1*c*), the measurement device 1 has a compact housing 2 having a substantially angular shape with its upper side curved and vertical sides slightly longer than the horizontal sides. A liquid-crystal display (LCD) portion 3 is provided on a front surface of the housing 2 on which the set mode of the measurement device 1 and/or the measured temperature is indicated as described later. A communication antenna 4 is extended on the top of the housing 2. Two sets of connectors 5 are provided on the left side of the housing 2, into which the temperature sensors can be plugged. Moreover, a serial communication connector 6 and a connector 7 for an AC adapter serving as an external power source are provided on the right side of the housing 2. Furthermore, a battery space 8 capable of admitting a dry battery is provided in a rear face of the housing 2.

Figure 1D:
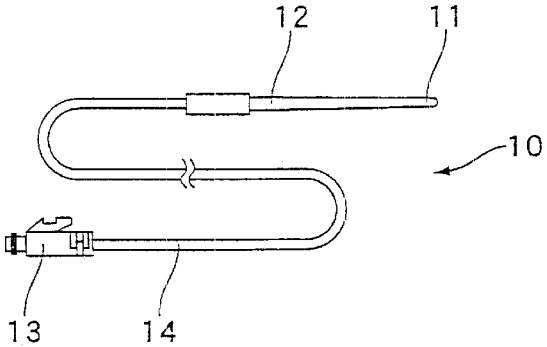

In Fig. 1*d*, a temperature sensor 10 that can be plugged into the connector 5 for sensor connection is shown. The temperature sensor 10 includes a stainless probe portion 12 that houses a thermistor 11 at its end portion, a connector 13 that can be plugged into the connector 5 of the housing 2, and a strand of Teflon-coated cable 14 that connects the probe 12 and the connector 13. When the temperature sensor 10 is connected to the measurement device 1 and the measurement device is set to the remote mode, the probe 12 detects the temperature at the installed location and the detected temperature at the predetermined timing is stored in the measurement device 1 as the measured data. The measurement device 1 transmits the measured data to a control device such as a personal computer by radio via another measurement device which is set as base mode.

Figure 2:
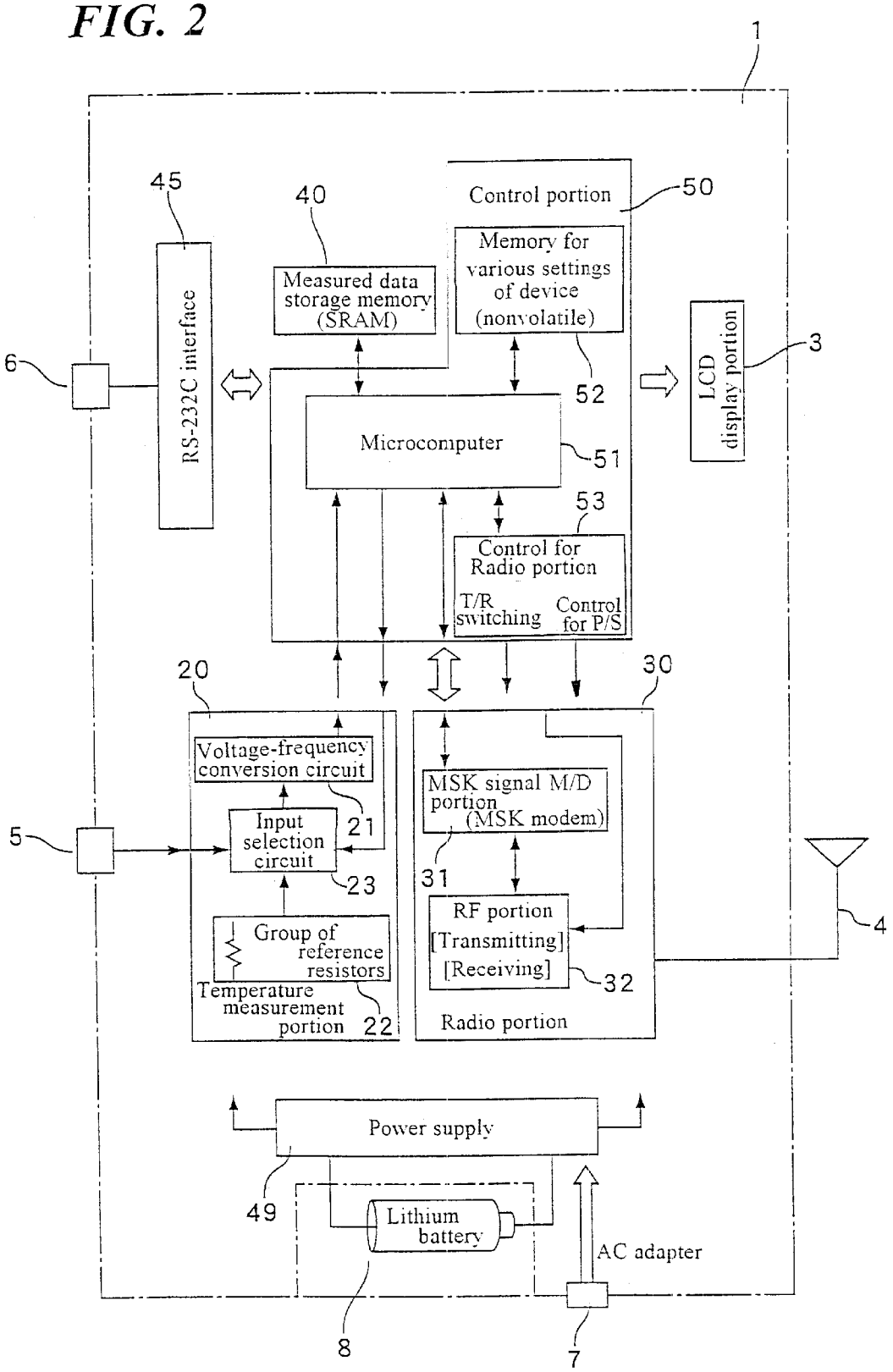
FIG. 2 is a block diagram showing an outline of a structure of the temperature measurement device shown in FIG. 1.

FIG. 2 shows an outline of a construction of the measurement device 1. The measurement device 1 of this embodiment includes a temperature measurement portion 20 for acquiring measured data from the sensor(s) connected to the connector 5, a memory (SRAM) 40 capable of storing the measured data, a radio portion 30 for performing radio transmission/reception of the measured data stored in or to be stored in the memory 40 with the antenna 4, and a serial interface 45 capable of supplying the measured data stored in the memory 40 to a computer via a serial communication cable connected to the connector 6. Further, the measurement device 1 includes a control portion 50 for controlling the temperature measurement portion 20, memory 40, radio portion 30, and serial interface 45. In addition to the controlling function, the control portion 50 has some functions such as indicating the measured data and state of the measurement device 1 on the LCD 3. Moreover, the measurement device 1 includes a power circuit 49 for supplying power to the respective function portions. In this embodiment, the power circuit 49 has the function for distributing power from the AC adapter connected to the connector 7 and the function for distributing power of the built-in battery provided in the battery space 8.

The temperature measurement portion 20 includes a frequency conversion circuit 21 capable of converting a resistance value of the thermistor 11 of the sensor 10 connected to the connector 5 into a frequency so as to generate digitized measured data, a group of reference resistors 22 which is necessary to acquire the measured data, and an input selection circuit 23 for selecting an input from either of the sensor 10 or the group of the reference resistors 22. The temperature measurement portion 20 acquires measured data from each channel (in this embodiment, two sensors are connectable, hence having a two-channel configuration) under the control of the control portion 50 at a predetermined time interval and supplies those data to the control portion 50. The control portion 50 stores the received measured data in the SRAM 40 sequentially.

The radio portion 30 of this embodiment is arranged to perform data transmission/reception through MSK signal modulation which can realize a lower error rate and a shorter frequency interval. Therefore, the radio portion 30 has an MSK signal modulation and demodulation portion 31 and an RF portion 32 including a circuit for transmitting/receiving modulated data. The MSK signal modulation and demodulation portion 31 is provided with a frame-pattern detection function. Upon receipt of a frame pattern that accords with predetermined individual identification information (calling frame pattern), the MSK signal modulation and demodulation portion 31 demodulates and outputs subsequent data.

The control portion 50 includes a microcomputer 51 and a non-volatile memory 52 for storing its program or set values. In this embodiment, an EEPROM is adopted as the memory 52 such that the set values referred for executing the program can be changed. Therefore, as will be described later in detail, action of the control portion 50 as well as functions of the device to the remote-mode, the base-mode, and the relay-mode can be switched. Further, the control portion 50 includes a radio portion control 53 for controlling the radio portion 30 for temporarily stopping the function of the radio portion 30 by cutting off the power supplied to the radio portion 30 and for switching the transmission and reception of the radio portion 30.

Since the measurement device 1 of this embodiment is provided with the measurement portion 20, the radio portion 30, the memory portion 40, and the serial interface portion 45, it is possible to realize either of three functions including the remote-mode performing the temperature measurement, the base-mode (parent-mode) collecting the measured data from the remote-mode devices, and the relay-mode relaying the remote-mode devices and the base-mode device by the measurement device 1 using the respective functions. The control portion 50 assigns the measurement device 1 to perform any of the aforementioned functions in accordance with the flag data previously set in the EEPROM 52.

In the remote mode, the temperature is measured at a predetermined measurement interval, for example, at 1 minute, and the measured data are stored in the SRAM 40 at a predetermined storage interval. In the SRAM 40, measured data are stored in the measured order in a repeated or endless mode. When the right time for transmission comes, those data are transmitted from the radio portion 30 by radio. Setting a predetermined transmission interval can control the timing for radio transmission of the data. Moreover, the device in base-mode is capable of directing radio transmission of the data in the device in remote-mode and a device in relay-mode.

Since the measurement device 1 has the memory 40 for storing an appropriate amount of data, in the state where the data are stored at the predetermined interval, the radio portion 30 is intermittently supplied with power so as to extend the battery life. For example, the measurement device 1 of this embodiment has the memory 40 capable of storing 1440 pieces of data, that is, the data derived from the measurement taken for about 24 hours can be stored even when the storing interval is set to 1 minute without activating the radio portion 30. However, since there may be a calling from the measurement device 1 in the base-mode or relay-mode, actually the remote-mode device starts up the radio portion 30 once every 35 seconds or so to check the presence of the call.

The measurement device 1 in the base-mode receives the data from the measurement device 1 set in the remote mode by the radio portion 30, and temporarily stores them in the SRAM 40. Then, the data stored in the SRAM 40 are supplied to the personal computer via the serial interface 45. Therefore, an application program installed in the personal computer can start some processing using the data acquired by the device in remote-mode.

Moreover, upon receipt of a request from the application program to collect the data, the base-mode device transmits the request to the remote-mode device and collects the data regularly or irregularly. Furthermore, the base-mode device can send the command for changing the storing interval of the measurement device 1 set in the remote-mode through radio transmission/reception portion 30.

It is also possible for the measurement device 1 in the base mode to add an alarm function by collecting the data from the measurement devices 1 in the remote mode at an appropriate interval and supplying them to the application program. The alarm function serves to output an alarm in accordance with the judgement whether or not the data collected at the appropriate interval reach a predetermined value or whether or not there is a possibility of reaching that value.

Further, when the measurement device in the relay mode receives the data at the radio portion 30 through radio transmission from the measurement device 1 set in the remote mode, those data are temporarily stored in the SRAM 40. Then, the measurement device 1 in the relay mode performs radio transmission of the data stored in the SRAM 40 to the measurement device 1 in the base-mode by the radio portion 30. By the measurement device 1 set in the relay mode, the measurement device 1 in the remote mode can be installed in such a position at longer distance or blind site where the strength of the radio wave is insufficient and made to measure the temperature and transmit the measured data.

In the base-mode device and relay-mode device, there is the possibility of an occurrence of the transmission/reception at any time. Therefore, preferably, the measurement device in such modes is supplied with the power from an external power source through the AC adapter in order to prevent the stop of the function due to the short of battery power.

Figure 3:
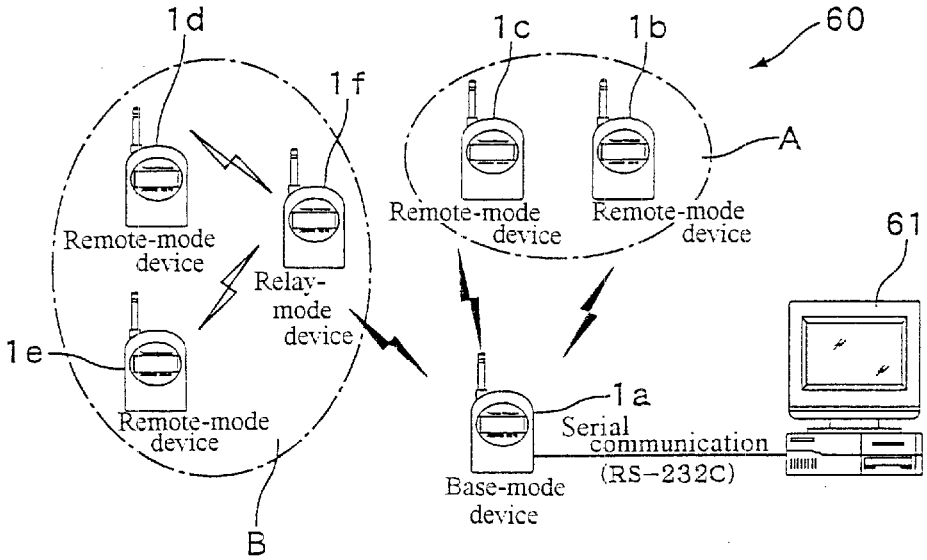
FIG. 3 is a view showing an example for the measurement system using the measurement devices shown in FIG. 1.

Thus, the measurement device 1 of this embodiment can perform radio transmission/reception of the data, and further by altering set values of the control portion 50, the measurement devices 1 of the identical specifications can be used as either one of the remote-mode device, the base-mode device, or the relay-mode device. Therefore, as shown in FIG. 3, a temperature measurement system 60 for measuring temperatures at a large number of measuring points and collecting the measured data can be easily constructed. In the measurement system 60, the measurement device 1*a* set in the base-mode is wire-connected to a personal computer 61 via a serial cable. For the measurement device 1*a* in the base-mode, two measuring groups A and B are set up or allocated. One group A includes the measurement devices 1*b* and 1*c* set in the remote mode. The other group B includes the measurement devices 1*d* and 1*e* set in the remote mode and additionally the measurement device 1*f* set in the relay mode serving to relay the radio communication. Using the measurement devices of this embodiment, the present measurement system 60 can be easily constructed only with six units of the measurement devices 1 of the identical specifications with no transmission cables. It is needless to say that the number of the groups is not limited to two. For example, the measurement device 1 that can control 32 groups as the base-mode device and each group includes up to 126 units of the remote-mode devices is able to be provided.

By connecting each measurement device 1 to the personal computer 61 via the serial interface 45 and setting its mode with an application program, the mode setting of the measurement device 1 is performed. In the setting process, when the measurement device is set in the remote mode, other information specifying the measurement device serving as the remote-device, such as a group code to which the remote-mode device belongs, the presence or absence of the relay-mode device, and a serial number or individual identification information (calling frame pattern) are installed or downloaded. The measurement device set in the relay mode is also set to have identification information such as the group code or the serial number thereof. Therefore, using a plurality of the measurement devices 1 of the identical or single set of specifications, the measurement system required by the user can be constructed freely.

Figure 4:
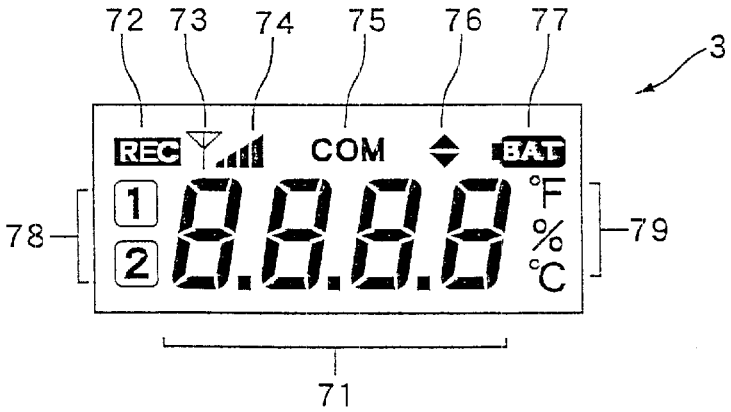
FIG. 4 is an enlarged view of a display panel of the measurement device shown in FIG. 1.

The mode set in the measurement device 1 is indicated on the liquid-crystal display panel 3. FIG. 4 is an enlarged view of the panel 3. When the device is set in the base-mode, the display portion 71 in the middle of the panel 3 shows characters identifying base-mode such as "BASE". When in the relay mode, it shows characters identifying relay-mode such as "RELA". When being set in the remote mode, the display portion 71 indicates the measured temperature.

In addition, several pieces of information are indicated on the display panel 3. In the indication positions aligned in the upper portion of the display panel 3, there are provided from the left side, a recording mark 72 indicating that measured data are temporarily stored, an antenna mark 73 indicating that it is ready for radio communication, a mark 74 indicating the strength of the radio wave, a mark 75 indicating that the data are transmitted/received, a mark 76 indicating that a temperature being measured goes over a predetermined upper limit or lower limit, and a battery life alarm mark 77 indicating exiguity of the battery. On the left end of the display panel 3, marks 78 indicating a channel on which the measured data being indicated is measured are located. On the right end, marks 79 indicating a unit of the measured temperature are located. The indication of "%" among the marks 79 shows the strength of the radio wave when it is checked.

Figure 5:
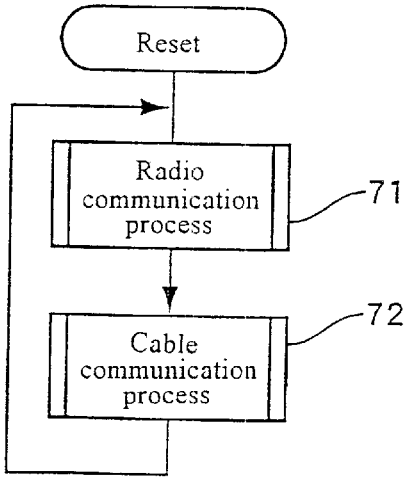
FIG. 5 is a flowchart illustrating the operation of the measurement device shown in FIG. 1.
Figure 6:
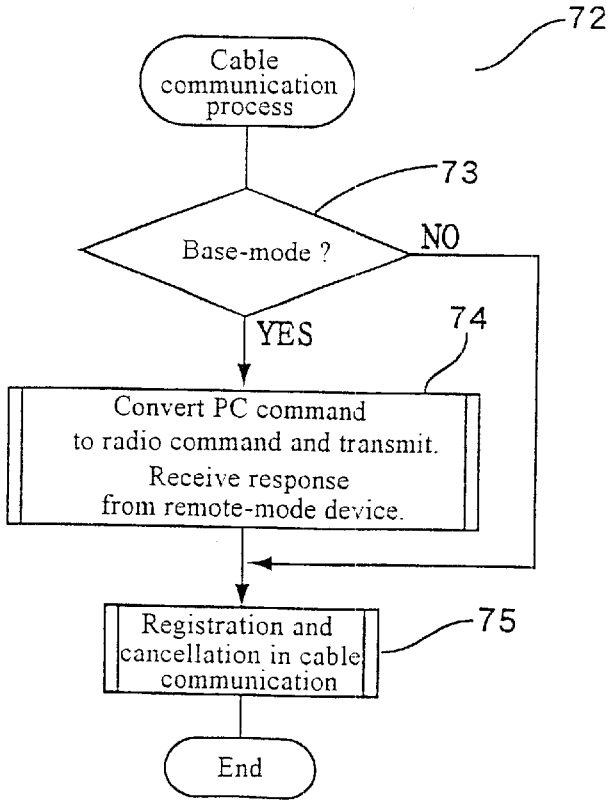
FIG. 6 is a flowchart illustrating a more detailed operation of cable communication processing.
Figure 7:
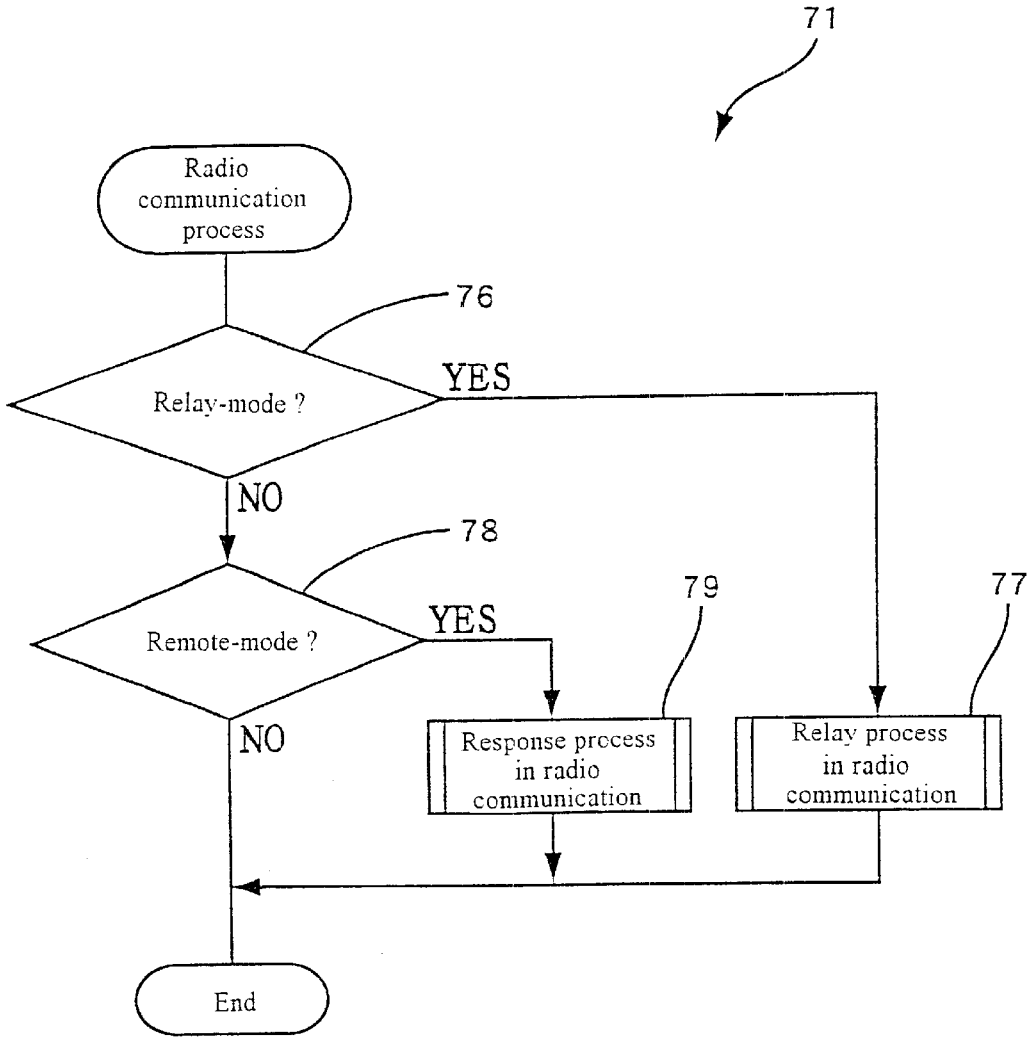
FIG. 7 is a flow chart illustrating a more detailed operation of radio communication processing.

Referring to FIG. 5 to FIG. 7, operation of the measurement device 1 of this embodiment will be described further. When the measurement device 1 of this embodiment, as shown in FIG. 5, undergoes initial setting including the mode setting and is reset/restarted, process using the radio communication 71 and process using the cable communication 72 are performed according to the mode setting. The processing in the cable communication 72 shown in the drawing is processing of communication with the personal computer, specifically in this embodiment, the processing in the cable communication using the serial interface. If an infrared ray interface is used, the process of 72 becomes process in the radio communication but such process is also included in the process 72. In either case, the process 72 is a data exchange performed using the universal interface provided in the personal computer. Therefore, by connecting the measurement device 1 in the base-mode with the personal computer, a general-purpose personal computer can be incorporated as a control device or monitoring device in the measurement system where the data are exchanged by radio, and further as a terminal device that is part of the even larger system.

FIG. 6 shows a routine of the cable communication processing. First in step 73, a mode assigned to the measurement device 1 is confirmed. If the mode is set in the base-mode, the command from the personal computer (PC) is converted into a radio command and transmitted it to the measurement system constructed with the measurement devices set in the remote-mode or the relay-mode respectively in step 74. In addition, the base-mode device receives a response from the measurement devices set in the remote-mode or the relay-mode. Any non base-mode device, that is, any remote-mode device and relay-mode device do not receive the command directly from the personal computer so long as they are serving as part of the measurement system. However, if such a device is directly connected to the personal computer 61 via the serial interface 45, the processing of registration and cancellation of the mode can be performed. As a result, the remote-mode can be switched to the relay-mode or base-mode or vice versa. Further, processing for altering group formation of the remote-mode devices can be performed by the same way.

FIG. 7 shows a routine of the radio communication processing. The mode assigned to the measurement device 1 is confirmed in step 76. If the measurement device 1 is set in the relay-mode, the process proceeds to step 77 where processing of relay in the radio communication is performed. In this processing, when the relay-mode device 1 receives the data or the command by radio from any measurement device 1 set in the base-mode or the remote-mode and included in the subject group to be connected via the subject relay-mode device, the relay-mode device transmits the data or the command as they are to the forwarding base-mode or remote mode device 1. By temporarily storing received data and/or command in the SRAM 40 then transmitting to the forwarding device 1, the relay-mode device proceeds process only one of the transmission or reception. Moreover, by processing either one of the transmission or reception, the communication time with an individual measurement device can be shortened compared to the case where bilateral communication is simultaneously processed. Shorten the time for communicating with the measurement device 1 set in the remote-mode reduces its battery consumption.

In step 78, when the mode assigned to the measurement device 1 is the remote-mode, the process proceeds to step 79 where the measurement device 1 responds in the radio communication as the remote-mode device. In the measurement device 1 of this embodiment, the processing of the temperature measurement is regularly performed as the interrupt processing irrespective of the mode setting. Therefore, simply connecting the sensor to the device 1 can perform the temperature measurement. Then, when the measurement device 1 is in the remote-mode, the measured data are stored in the SRAM 40, and the data are collected via the measurement device 1 in the base-mode.

In the radio communication processing of the remote-mode device, it is essential to reduce the battery consumption thereof. Therefore, in the measurement device 1 of this embodiment, by performing intermittent transmission/reception with intermittent operation of the radio portion 30, the battery life is extended.

Figure 8:
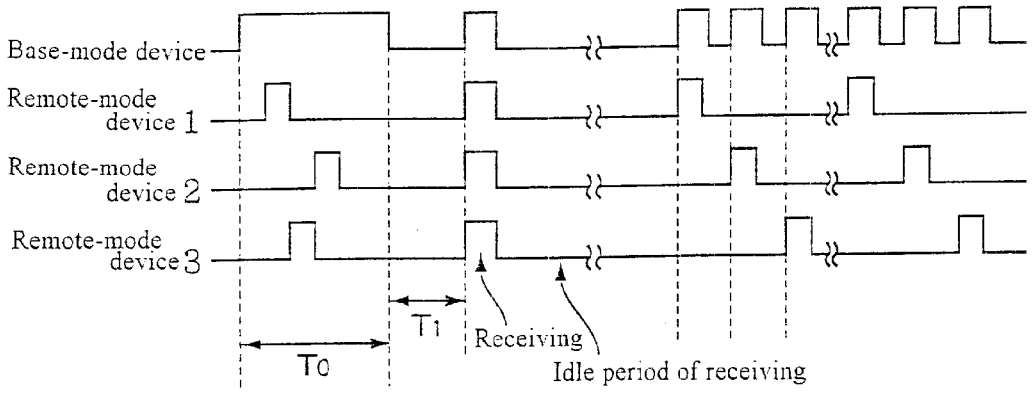
FIG. 8 is a timing chart showing an example of intermittent data transmission/reception.

FIG. 8 shows one example of timing adjustment for performing the intermittent transmission/reception. Since the measurement device 1 is provided with the memory 40 for storing the measured data, frequent transmission of the data is not necessary. However, it is required to avoid overlap of timing for data transmission with the other measurement device set in the remote-mode, or to respond to the call from the measurement device 1 set in the base-mode at any time. Therefore, the measurement device 1 energizes the reception function at an appropriate intermittent interval so as to confirm whether or not the command carrying the its identification information has been transmitted, for maintaining the communication function and reducing power consumption of the power source. For example, in order to confirm the presence or absence of the call among a plurality of channels, it is necessary to set a period of reception for about 500 ms. If the idle period of reception is set to 35 seconds, the intermittent cycle of radio transmission becomes 70:1. Assuming that the intermittent cycle is set as described above, the measurement device 1 in the remote-mode in the temperature measurement system is capable of extending its battery life up to almost four months approximately or longer.

However, in order to perform such intermittent transmission/reception, it is necessary for the base-mode device to continue to transmit the command for calling the specific remote-mode device throughout the intermittent period, thus by that command transmission, the operation speed is decreased. Meanwhile the remote-mode device is not allowed to respond to the call unless the base-mode device terminates that command transmission. If the remote-mode device continues to receive the command to find the timing, excessive amount of power will be consumed. If the remote-mode device starts countdown after receiving the command and then responds, the response timing may shift. As a result, other remote-mode device may interrupt the communication with the base-mode device.

In order to solve the foregoing problems, in the measurement device 1 of this embodiment, a broadcast call that calls all the remote-mode devices (all the remote-mode devices of each group may be called) for the period equal to or longer than the intermittent cycle T0 so as to synchronize the timing or timing counter when they receive the call. Then, at the elapse of a certain time (T1) after the end of the calling signal (the broad cast call), all the remote-mode devices are brought into the state ready for receiving and a timing counter (clock) of each remote-device is adjusted. The measurement device 1 of this embodiment does not have a clock function that outputs a time signal. Instead, the device detects a measurement interval, a storing interval, and even a communication interval by counting the clock pulses. Therefore, synchronizing the counter of the measurement device 1 for intervals and/or timing by the above-mentioned process, the communication timing among the measurement devices are adjusted. By this adjustment, the synchronization of the remote-mode devices is established, and thereafter, each of the remote-mode devices is brought into the ready-to-receive state in a predetermined order and at constant cycle. Therefore, although the communication function of each remote-mode device operates only intermittently, the base-mode device can transmit the command to a remote-mode device surely by transmitting the call signal thereto in synchronization with the timing of the remote-mode device. The identification number of the remote-mode device may specify the order of starting the receiving of remote-mode devices. The order of the remote-mode device may be specified separately, also.

As described above, the measurement device 1 of this embodiment can act as the remote-mode device, base-mode device and the relay-mode device by changing the setting itself. Therefore, the system for measuring temperatures at a plurality of points can be constructed with the measurement devices 1 designed and manufactured according to the single set of specifications. In addition, the system constructed by the present measurement devices 1 collect and send the data to the personal computer serving as a control device by radio. By virtue of this feature, an appropriate number of measurement devices 1 of the single set of specifications makes it possible to create the desired system flexibly. Moreover, the manufacturer for supplying measurement systems should only supply measurement devices 1 of the single set of specifications, which considerably simplifies the management of the production, store and sales, and reduces the possibility of an occurrence of loss due to over production and over stock. In addition, since the measurement devices of this embodiment have compatibility, the alteration of the system is carried out easily. Also for the maintenance, the measurement device 1 provides many merits such as the fact that only one kind of measurement device 1 need to be reserved as spares. Therefore, adoption of the measurement device of this embodiment makes it possible for both of the manufacturer and the user to construct the measurement system that can readily cope the failure or the system alteration.

As aforementioned, the present invention is described by taking an example of the measurement device for measuring temperatures. However, it is understood that physical values subjected to the measurement are not limited to the temperature. Moreover, a dipswitch or other hardware switch may be used for setting of the remote-mode device, the base-mode device, and the relay-mode device. However, in consideration of management of the other information such as the identification numbers to the devices for grouping, and the order of remote-mode devices for starting receipt of the call from the base-mode device, it may be better to manage the mode setting by the application program including the other information for being free from errors and for making management easily.

In the present embodiment, the personal computer to which the base-mode device is connected is used as the control device. The computers connected to the base-mode device for acting as control device may be connected with one another via a network such as LAN to build up the measurement system of a larger scale.

As described herein, the measurement device according to the present invention allows construction of the system for collecting, managing, and monitoring the data wireless. The system can be formed using the measurement devices of the single set of specifications, each unit of which can be easily set to either the remote mode, base-mode or relay mode required for construction of the system. Therefore, with the measurement devices according to the present invention, the measurement system that acquires measured data at a plurality of measuring points and collects these data can be constructed in accordance with various conditions flexibly, for example, kinds of articles to be monitored and/or measured, an area of installation of device, a building of installation of system. Moreover, the manufacturer for supplying the measurement devices can cover the whole system with products of a single set of specifications. Therefore the management of the production, sales, and inventory can easily be performed. The present invention is capable of coping with alteration or expansion of the system easily. In this regard, the measurement system with a high degree of design freedom can be constructed.

Further, in the measurement system with the measurement devices of the present invention, the failure or damaged measurement device owing to accident can be replaced by spare device easily, since only one kind of the replacement spares of measurement device is required. In addition, even when the user procures the spare devices from the manufacturer, the spare devices will be obtained in a short period of time because it is not necessary to specify their specifications. Therefore, with the measurement devices according to the present invention, a highly reliable measurement system can be constructed at lower costs.

The invention may be embodied in other specific forms without departing from the spirit or essential characteristics thereof. The present embodiments are therefore to be considered in all respects as illustrative and not restrictive the scope of the invention being indicated by the appended claims rather than by the foregoing description and all changes which come within the meaning and the range of equivalency of the claims are therefore intended to be embraced therein.

What is claimed is:

1. A measurement device comprising:

a measurement portion for acquiring data from a sensor;

a memory portion for storing the data;

a radio portion for performing radio transmission/reception of the data;

a PC interface portion for transmitting the data to a host computer via a universal interface; and a control portion for controlling the measurement portion, the memory portion, the radio portion, and the PC interface portion, the control portion has a switching function for setting a mode by selecting between a remote mode and base mode; in the remote mode, the data acquired by the measurement portion are stored in the memory portion and transmitted by the radio portion, and in the base mode, data acquired by the radio portion from another measurement device are stored in the memory portion and transmitted to the host computer by the universal interface.

2. A measurement device according to claim 1, wherein the control portion has the switching function for setting the mode by selecting among the remote mode, base mode, and a relay mode; in the relay mode, the measured data acquired by the radio portion from another measurement device are stored in the memory portion and transmitted by the radio portion.

3. A measurement device according to claim 1, wherein, in the remote mode, the radio portion is operated intermittently.

4. A measurement device according to claim 1, wherein the switching function is operable by the host computer via the PC interface portion.

5. A measurement device according to claim 1, wherein the control portion has identification information for transmission/reception being set by the host computer via the PC interface portion.

6. A communication method between a plurality of measurement devices of claim 1 having following steps:

the measurement device of the base mode transmits a broadcast call that calls the measurement devices of remote mode for a period equal to or longer than a intermittent cycle, wherein the call is received by the measurement devices of remote mode so as to synchronize timing counters of the measurement devices of remote mode; and after an end of the broadcast calling, the measurement devices of remote mode are brought into the ready to transmission/receive state in a predetermined order for transmitting data to the measurement device of base mode.

* * * * *